United States Patent [19]

Schlough

[11] Patent Number: 4,901,996

[45] Date of Patent: Feb. 20, 1990

[54] APPARATUS AND METHOD FOR FEEDING SHEET MATERIAL FROM A STACK FOR A COLLATING CONVEYOR

[75] Inventor: James R. Schlough, Morrisonville, N.Y.

[73] Assignee: AM International Incorporated, Chicago, Ill.

[21] Appl. No.: 244,937

[22] Filed: Sep. 15, 1988

Related U.S. Application Data

[63] Continuation of Ser. No. 928,896, Nov. 10, 1986, abandoned.

[51] Int. Cl.[4] ..... B65H 3/42; B65H 5/00; B65H 5/32

[52] U.S. Cl. ..... 271/10; 271/11; 271/35; 271/100; 271/106; 271/175; 271/187; 271/315; 270/54

[58] Field of Search ..... 271/4, 5, 10, 11, 12, 271/35, 82, 83, 91, 94, 95, 99, 100, 101, 102, 106, 175, 184, 187, 196, 204, 205, 206, 273, 275, 276, 277, 315; 270/54, 55, 56, 57; 414/128

[56] References Cited

U.S. PATENT DOCUMENTS

| | | | |
|---|---|---|---|
| 2,425,936 | 8/1947 | Hepp | 271/11 |
| 2,853,297 | 9/1958 | Faeber | 271/11 |
| 2,903,260 | 9/1959 | Faeber | 270/54 |
| 3,089,693 | 5/1963 | Gore et al. | 270/54 |
| 3,130,966 | 4/1964 | Hepp | 270/54 |
| 3,176,976 | 4/1965 | Hepp | 270/54 |
| 3,547,429 | 12/1970 | Hepp | 270/54 |
| 3,552,740 | 1/1971 | Hepp | 271/12 |
| 3,945,633 | 3/1976 | Knopp | 271/3.1 |
| 4,127,262 | 11/1978 | Eberle et al. | 271/12 |

FOREIGN PATENT DOCUMENTS

| | | | |
|---|---|---|---|
| 1012970 | 12/1965 | United Kingdom | 271/95 |

*Primary Examiner*—F. J. Bartuska
*Assistant Examiner*—Edward S. Ammeen
*Attorney, Agent, or Firm*—Tarolli, Sundheim & Covell

[57] ABSTRACT

An apparatus for removing signatures from a hopper includes a rotatable drum. A first feeder mounted within the drum removes a first signature from the hopper during rotation of the drum through a predetermined acruate distance. A second feeder mounted within the drum partially removes a second signature from the hopper during rotation of the drum through the predetermined arcuate distance before the feeding of the first signature from the hopper is completed. The second feeder engages the second signature and starts removal of the second signature from the hopper while the first feeder is finishing removal of the first signature from the hopper.

22 Claims, 11 Drawing Sheets

APPARATUS AND METHOD FOR FEEDING SHEET MATERIAL FROM A STACK FOR A COLLATING CONVEYOR

This is a continuation of co-pending application Ser. No. 928,896 filed on Nov. 10, 1986, now abandoned.

BACKGROUND OF THE INVENTION

1. Field of the Invention

The present invention relates to signature handling. Specifically, the present invention relates to a collator feeder for removing signatures from a stack in a hopper and delivering the signatures to a conveyor of the collator.

2. Description of the Prior Art

A feeder for removing signatures from a hopper and delivering the signatures to a collating conveyor is known. One known feeder includes a rotating drum having gripper mechanisms spaced circumferentially thereabout. A separating mechanism separates one signature from the bottom of the stack of signatures in the hopper. One of the gripper mechanisms removes the separated signature from the hopper as the drum rotates past the hopper. The gripper mechanism releases the signature after a predetermined amount of drum rotation to deliver the signature to the collating conveyor. This known feeder is limited in speed of operation because the gripper mechanism "yanks" the signature from a standstill from the hopper which tends to tear the signature if the drum is rotated at a relatively high speed.

Another type of feeder is disclosed in U.S. Pat. Nos. 3,552,740 and 2,903,260. These patents disclose rotatable drums each having a plurality of elongated rollers circumferentially spaced within the periphery of the drum. The longitudinal axes of the rollers extend parallel to the axis of rotation of the drum. The rollers are driven to rotate at a speed proportional to the speed of rotation of the drum and in an opposite direction. Each of the rollers has a gripper mechanism which removes a signature from a hopper as the drum rotates past the hopper. As the drum rotates past the hopper, the signature is "peeled" off the stack by the gripper mechanism and stored on the surface of the roller. Very little force is imparted to the signature by the gripper mechanism because the speed at which the roller rotates relative to the signature during drum rotation is low.

This type of feeder is limited in the speed at which it can operate because one signature must be completely removed from the hopper before the next signature can be removed. This results from a fixed arcuate distance existing between adjacent rollers about the drum.

In U.S. Pat. No. 4,127,262 another type of signature feeder is disclosed in which one signature is removed from the bottom of a stack of signatures while a second signature is starting to be removed. The apparatus delivers the signature to a transversely extending conveyor in a "shingled" arrangement. This apparatus is capable of signature removal at a relatively high rate. However, it is not adapted for use in a collator. Thus, improvements are needed to increase the speed at which signature feeding from a hopper can be accomplished.

SUMMARY OF THE INVENTION

The present invention is a novel and improved method and apparatus for feeding signatures from a stack. Specifically, the method and apparatus of the present invention provides a way to increase the speed at which signatures are removed from a hopper and delivered to a collating conveyor.

The apparatus of the present invention is for use in a collating apparatus for feeding signatures from a hopper to a collating conveyor. The hopper holds a stack of signatures. A rotatable drum is disposed between the hopper and the collating conveyor. The axis of rotation of the drum extends perpendicular to the collating conveyor path.

The apparatus removes a first signature from the bottom of the hopper while it starts to remove of a second signature. A first feeder is mounted on the drum to remove or feed a first signature from the hopper during rotation of the drum through a predetermined arcuate distance. A second feeder is mounted on the drum which partially removes or feeds a second signature from the hopper during rotation of the drum through the predetermined arcuate distance while the removal of the first signature is being completed.

The apparatus of the present invention also stores the signatures within the periphery of the drum for a period of time corresponding to a predetermined amount of rotation of the drum. The feeder includes surface means defined by a belt which has a portion disposed along a portion of the outer circumference of the drum and which moves in a direction opposite that of drum rotation. The belt at the surface of the drum is driven at a speed substantially equal to the speed at the surface of the drum. Thus, the feeder removes the signature from the hopper at zero relative velocity between the signature and the feeder. A further feature of the present invention is that signatures folded at a leading edge relative to drum rotation are opened at their trailing edge prior to feeding to the collating conveyor, which is preferably a saddle conveyor. Thus, the signatures are delivered onto signature support bars of the saddle conveyor in a straddling relationship.

BRIEF DESCRIPTION OF THE DRAWINGS

Further features of the present invention will become apparent to those skilled in the art to which the present invention relates from a reading of the following specification made with reference to the accompanying drawings, in which.

DESCRIPTION OF A PREFERRED EMBODIMENT

Figure 1:
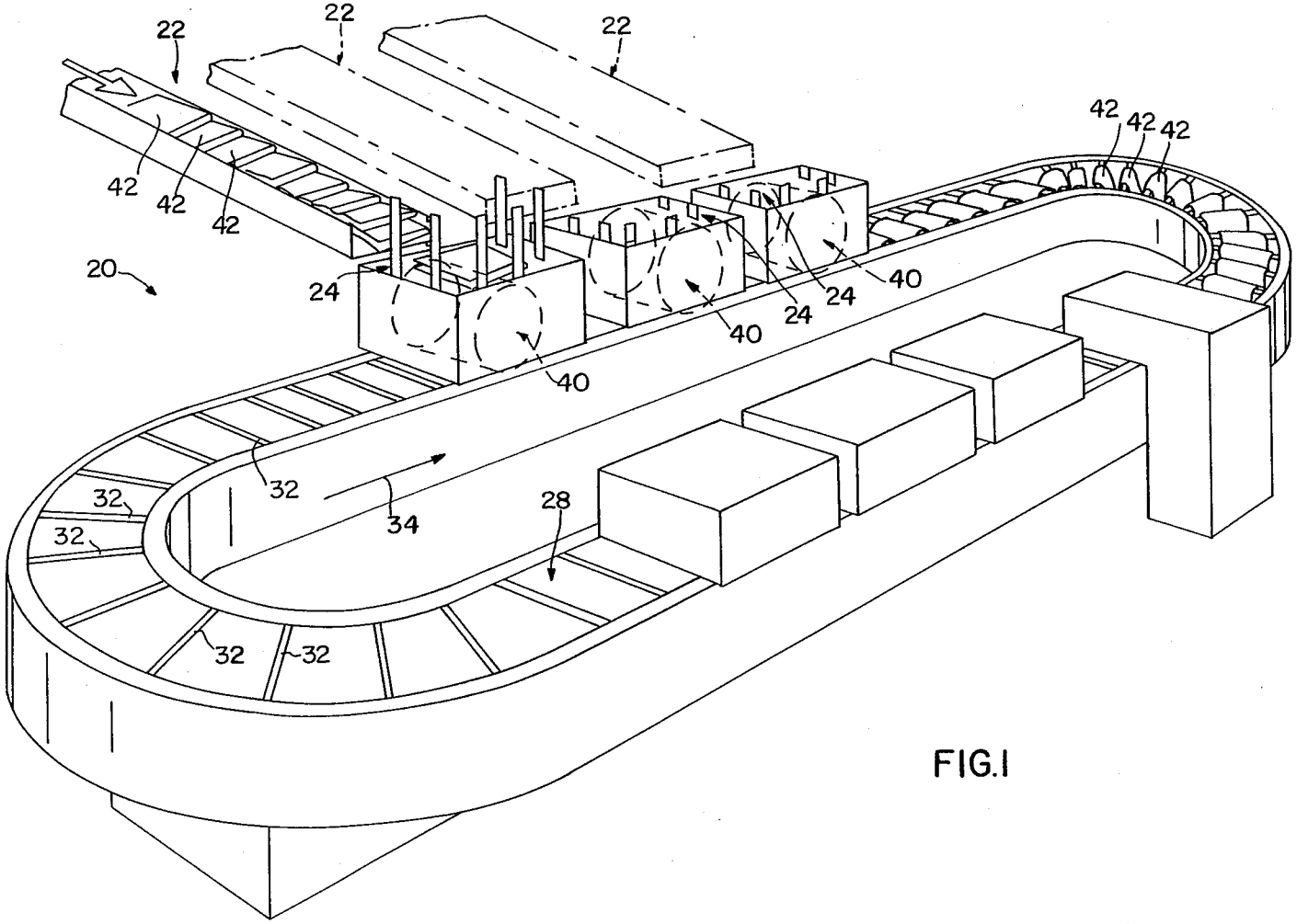
FIG. 1 is a perspective view of a collator embodying the present invention.

A signature collating apparatus 20 incorporating the present invention is illustrated in FIG. 1. The signature collating apparatus 20 includes a plurality of hopper loaders 22, a plurality of associated hoppers 24, a collating conveyor 28, and a plurality of collator feeders or signature handling apparatuses 40 embodying the present invention. The conveyor 28 moves a plurality of support bars, or saddles, 32 along a path 34 past signature handling apparatuses 40. The support bars 32 move along the path 34 with their longitudinal axes extending perpendicular to the path.

A plurality of signatures 42 are fed from a traditional hopper loader 22 of the type disclosed in U.S. Pat. No. 3,945,633, which is herein incorporated by reference. Each of the signatures 42 is folded and has a folded edge portion, an open end portion, and a pair of sheet sections connected at the folded edge portion. The signatures 42 are fed from the hopper loader 22 into the hopper 24 to form a stack in the hopper. The signatures 42 are arranged in the hopper 24 with the folded edge portions trailing relative to the direction of movement of conveyor 28 which is indicated by the arrow 34 in FIG. 2.

Each signature handling apparatus 40 (FIG. 2) includes an elongated cylinder, or drum, 52. The drum 52 is supported for rotation by a coaxial shaft 54. The drum 52 includes a plurality of feeders 62 spaced about the circumference of the drum 52. In the preferred embodiment, eight feeders 62 are illustrated. However, it will be apparent that a different number of feeders 62 may be used.

Each of the feeders 62 removes a respective signature 42 from the hopper 24 as the drum 52 rotates past the hopper. The drum 52 rotates in the counterclockwise direction, as viewed in FIG. 2, indicated by the arrow 56. Each of the feeders 62 removes a signature 42 from the bottom of the hopper 24 at the folded edge portion, which is the leading edge relative to the direction of drum rotation 56. The signature 42 is temporarily stored within the drum 52 for a predetermined arcuate distance of rotation of the drum. The feeder 62 opens the signature and delivers the signature 42 to a respective saddle, or support bar, 32 moving along the path 34 below the signature handling apparatus 40.

Figure 2:
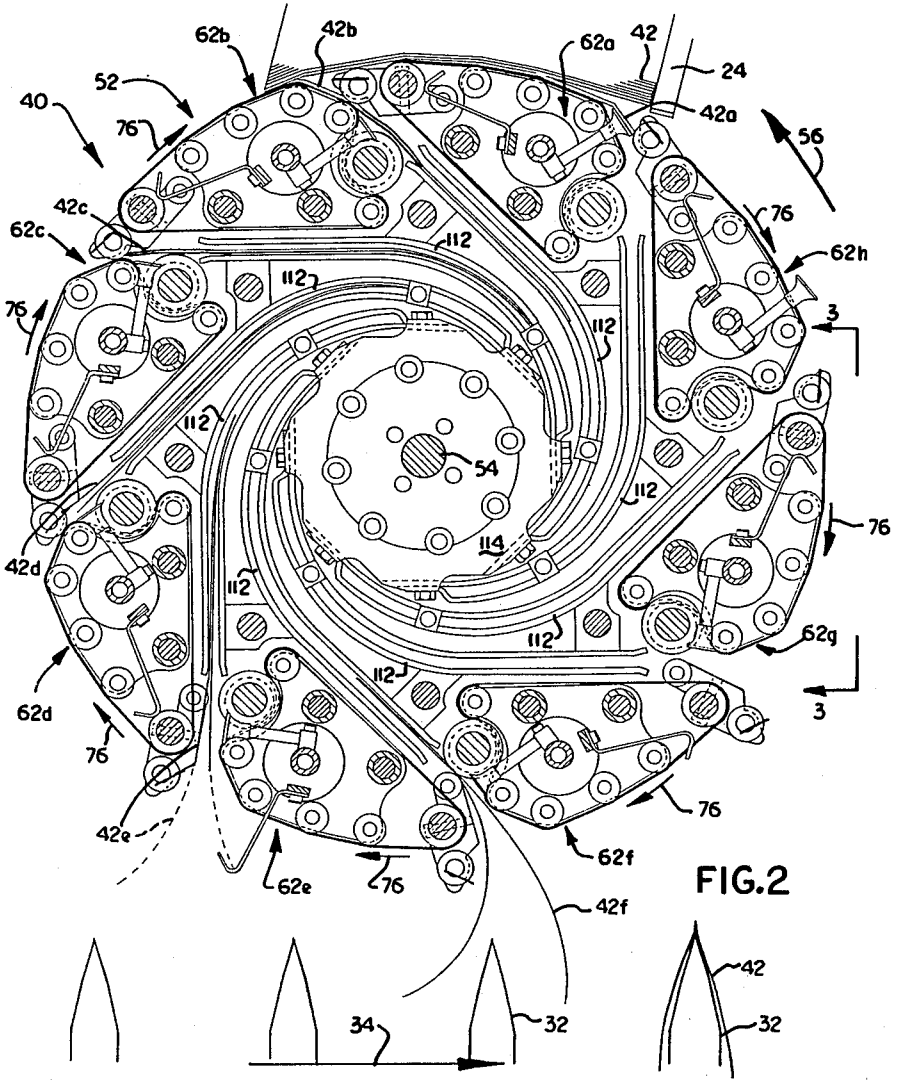
FIG. 2 is a side elevational view of a collator feeder embodying the present invention.

The feeder 62 provides the advantage over known signature handling mechanisms in that it performs several operations concurrently which enables the signature handling apparatus 40 embodying the present invention to operate at a relatively high speed. For example, as illustrated in FIG. 2, the feeder 62*a* just starts to remove a signature 42*a* from the hopper 24. At the same time, the feeder 62*b* has nearly completed removal of the signature 42*b* from the hopper 24. Feeder 62*c* has the signature 42*c* completely removed from the hopper 24 and stored within the drum 52. Feeder 62*d* is starting to open the signature 42*d*. Feeder 62*e* is completing the opening of the signature 42*e*. The feeder 62*f* is delivering the signature 42*f* onto a support bar 32 moving along the path 34. Feeders 62*g* and 62*h* are returning to positions for starting the feed cycle over again.

Figure 3:
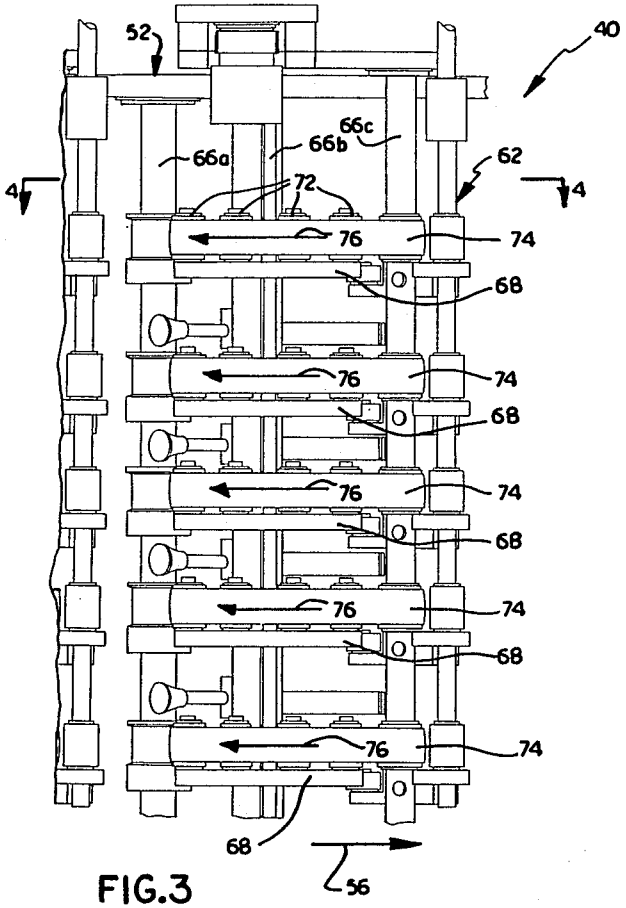
FIG. 3 is a front elevation, taken approximately along the line 3—3 of FIG. 2, of a feeder of the collator feeder.

A typical one of the feeders 62 is illustrated in FIG. 3. The feeder 62 includes shafts 66*a*, 66*b*, 66*c*. The shafts 66*b* and 66*c* are rotatably supported by sides of the drum 52 and actuated by known cam mechanisms (not shown). Shafts 69 (FIG. 4) support a plurality of plates 68 in bushings 70. Each of the plates 68 and shaft 66*c* support a plurality of rollers 72 about which a belt 74 is entrained. The belt 74 has a portion 75 partially defining a portion of the outer surface of the drum 52. The belts 74 are driven so that the portion 75 of the belts which define the portion of the surface of the drum 52 moves opposite the direction of rotation 56 of the drum, as indicated by the arrows 76 (FIG. 2).

Each of the feeders 62 also includes a plurality of grippers 82 which operate to remove, or peel off, the leading or folded edge portion of a signature 42 from the bottom of the stack of signatures in the hopper 24. The grippers 82 are fixed to the shaft 66*b*. The shaft 66*b* is actuated to pivot in a timed relationship with rotation of the drum 52 by known cam mechanisms (not shown) which will not be further described. Another shaft 86 is disposed about and coaxial with the shaft 66*b* and is also supported for pivotal movement. Bent wire openers 88 are attached to the shaft 86. The bent wire openers 88 operate to open a signature 42 just prior to delivery of the signature from the feeder 62. The openers 88 are similarly cam actuated in a timed relationship with the rotation of the drum 52. The feeder 62 includes an opener arm 96 which is pivotal about a pin 97 on a support bracket 98 on an adjacent feeder. The opener arm 96 engages one of the sheet sections of the signature 42 to initiate opening of the signature.

The feeder 62 includes pincher rollers 92*a* and 92*b* carried on the support bracket 98 which is connected to the shaft 66*c*. The pincher rollers 92*a*, 92*b* pivot about the shaft 66*c* in a timed relation with rotation of the drum 52 by known cam mechanisms. The pincher 92*a* engages the signature 42 to feed the signature into the drum 52. The pincher 92*b* engages the signature 42 to feed the signature out of the drum 52. The feeder 62 also includes an out-feed roller 102 supported for rotation on shaft 66*a*. The out-feed roller 102 engages the belt 74 and is driven to rotate in the direction indicated by the arrow 106. When the pincher roller 92*b* of an adjacent feeder forces the signature 42 against the out-feed roller 102, the out-feed roller applies a frictional force to the signature to feed the signature from the drum 52. Thus, it is seen that adjacent feeders 62 work in concert to feed signatures 42 into and out of the drum 52.

The feeder 62 also includes a storage rack 112 fixed to the drum 52 at hub 114 and at support 116. The storage rack 112 temporarily stores the signature 42 during rotation of the drum 52 through the predetermined arcuate distance of rotation. The storage rack 112 receives the signature 42 with the folded edge portion leading, or directed first into the storage rack. The folded edge portion of the signature 42 engages a stop 118 which establishes how far the signature may extend into the storage rack 112. The stop 118 is adjustable along the length of the storage rack 112. Thus, the storage rack 112 can be adjusted to accommodate various size signatures 42.

The stop 118 is adjustable so that the leading edge portion of the signature 42 is positioned in a predetermined location relative to the storage rack 112. The location of the stop 118 is established by the length of the signature 42, so the open end portion of the signature extends into the storage rack 112 a predetermined distance. The predetermined distance is established so that the trailing edge, or open end portion, of the signature is adjacent the out-feed roller 102 and pincher roller 92*b*.

The operation of the signature handling apparatus 40 is described below. One typical feeder 62 is described making a complete revolution about the axis A of rotation of the drum. While the operation of just the one feeder 62 is described in detail, it must be noted that the other seven feeders 62 are concurrently performing other operations.

Figure 4:
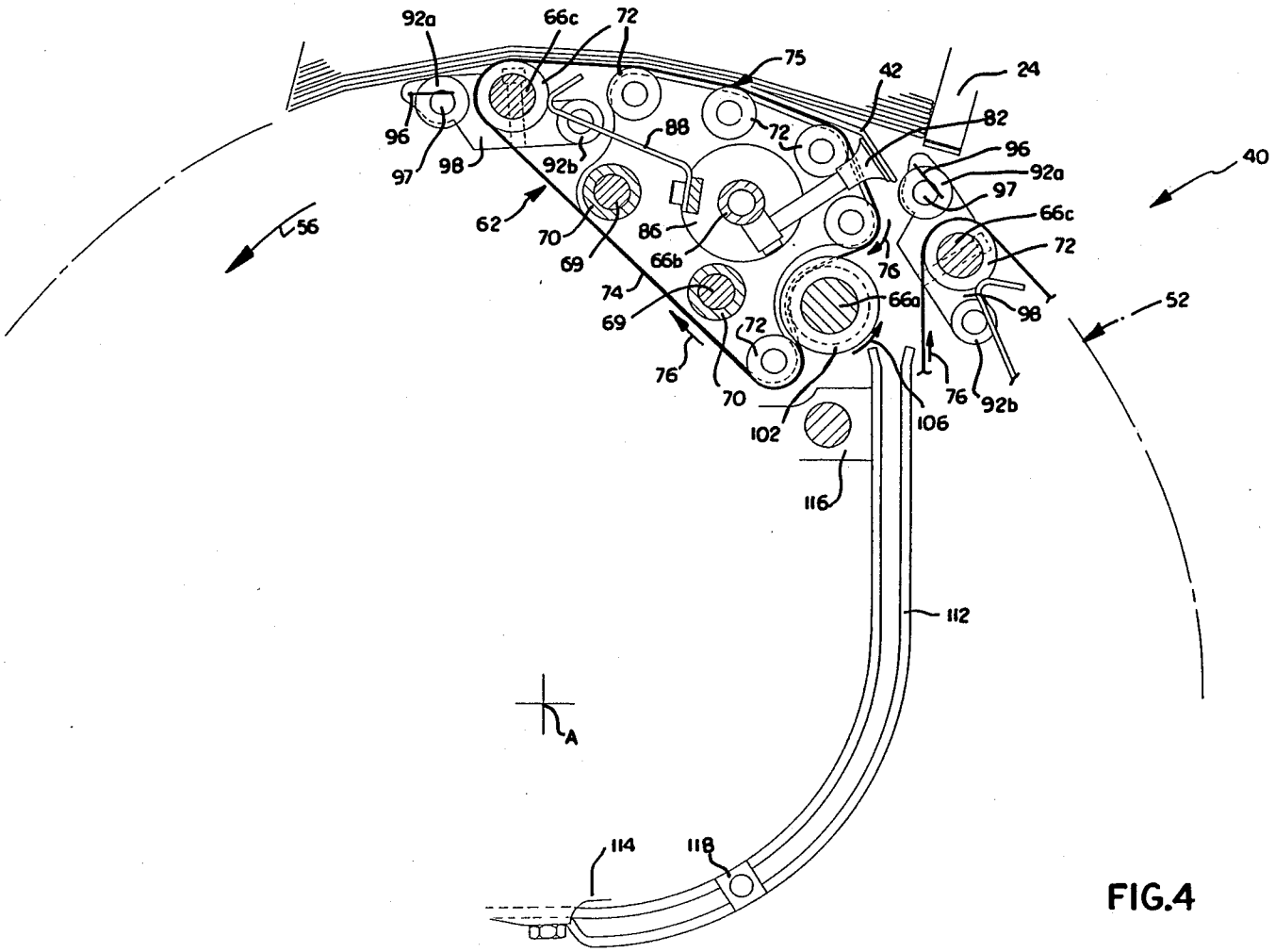
FIGS. 4–12 are enlarged side views, taken approximately along the line 4—4 of FIG. 3, of one feeder of the collator feeder in various operating positions during rotation of a drum which supports the feeder.

FIG. 4 illustrates the feeder 62 in a location during rotation of the drum 52 where the feeder is just beginning to remove the signature 42 from the hopper 24. The gripper 82 engages the leading, or folded, edge portion of the signature 42. The gripper 82 is of a known type. At an appropriate predetermined position of rotation of the drum 52, the resilient tip of the gripper 82 is subjected to vacuum to grip and peel the leading edge portion of the signature 42 from the bottom of the stack in the hopper 24. As the drum 52 continues to rotate, the gripper 82 pivots clockwise, as viewed in FIG. 4, pulling the signature 42 further downwardly from the hopper 24.

As the signature 42 is pulled downwardly, the surface of the belts 74 defining the portion 75 of the outer circumference of the drum 52 engage the signature. The belts 74 move in the direction 76 at a surface speed substantially equal to the surface speed of rotation of the drum 52 in the direction 56. Thus, the signature 42 is removed from the hopper 24 without being accelerated from a standstill to the speed of rotation of the drum 52 in a very short period of time. The signature 42 is thus merely peeled from the bottom of the stack and directed downwardly into the feeder 62. This type of signature removal reduces the tendency of the signature 42 to tear. That is, thinner signatures 42 are more prone to tear than thicker signatures in some of the known signature handling apparatuses. Thus, the speed at which the signature handling apparatus 40 operates is not dependent on the thickness or strength of the signature 42. Therefore, the signatures 42 can be removed by the signature handling apparatus 40 from the hopper 24 at a relatively high rate.

Figure 5:
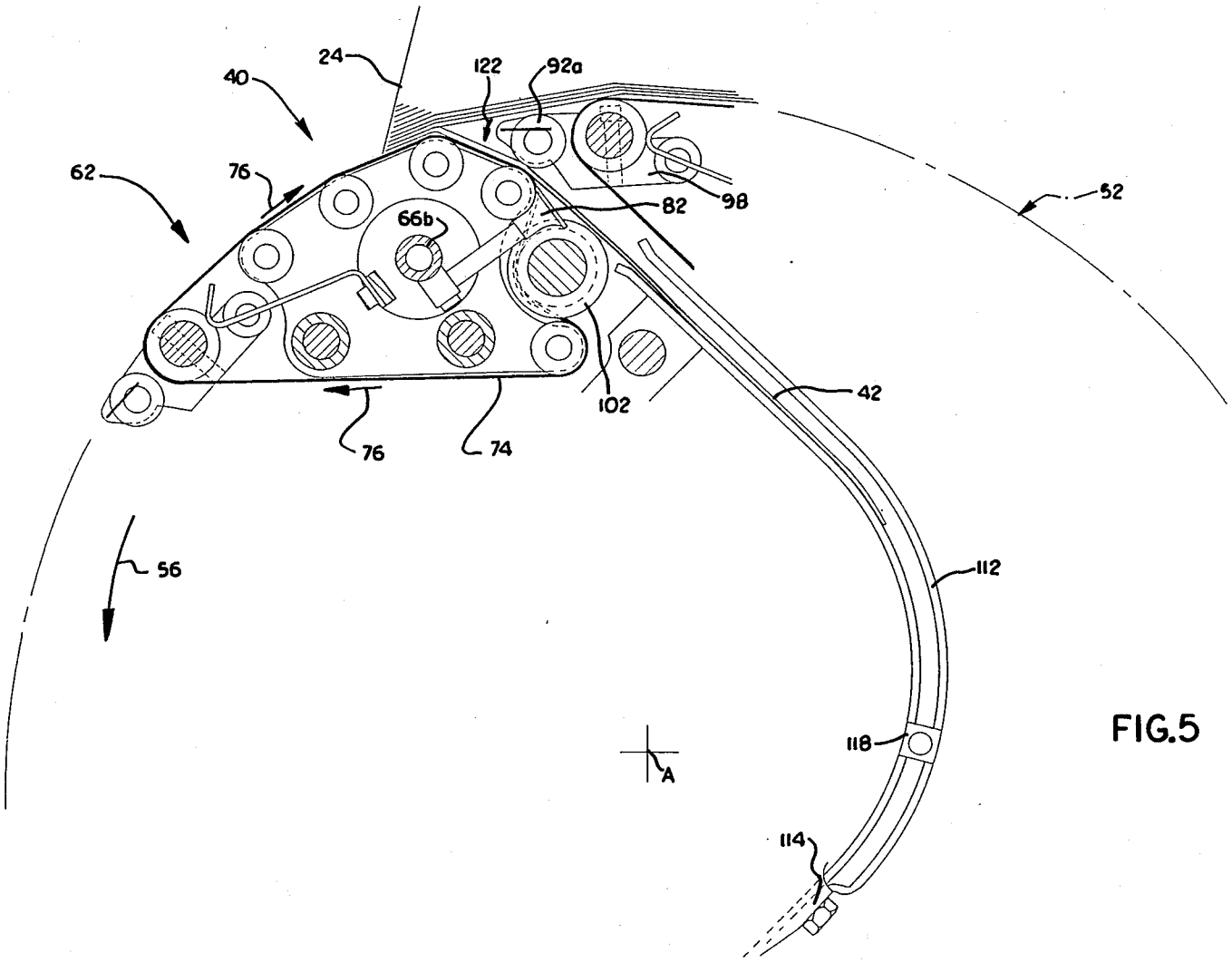

FIG. 5 illustrates the feeder 62 rotated in the direction 56 a predetermined arcuate distance from the position of FIG. 4. In the position of FIG. 5, the signature 42 has been almost completely removed from the hopper 24 and is almost entirely located within the storage rack 112. It is at this time that the following feeder 62, in the direction 56 of rotation of the drum 52, would start to pull the next signature from the hopper 24. The support bracket 98 and pincher roller **92*a* of the following feeder pivot in the direction indicated by the arrow 122. The pincher roller 92*a* engages the signature 42 and forces the signature against the belts 74 to frictionally drive the signature into the storage rack 112 in the drum 52. The signature 42 is driven into the storage rack 112 because the belts 74 moves in the direction 76. The gripper 82 pivots clockwise about the shaft 66*b* and disengages the signature 42. Thus, the only driving force on the signature 42 is the friction exerted by the belts 74 moving in the direction 76**.

Figure 6:
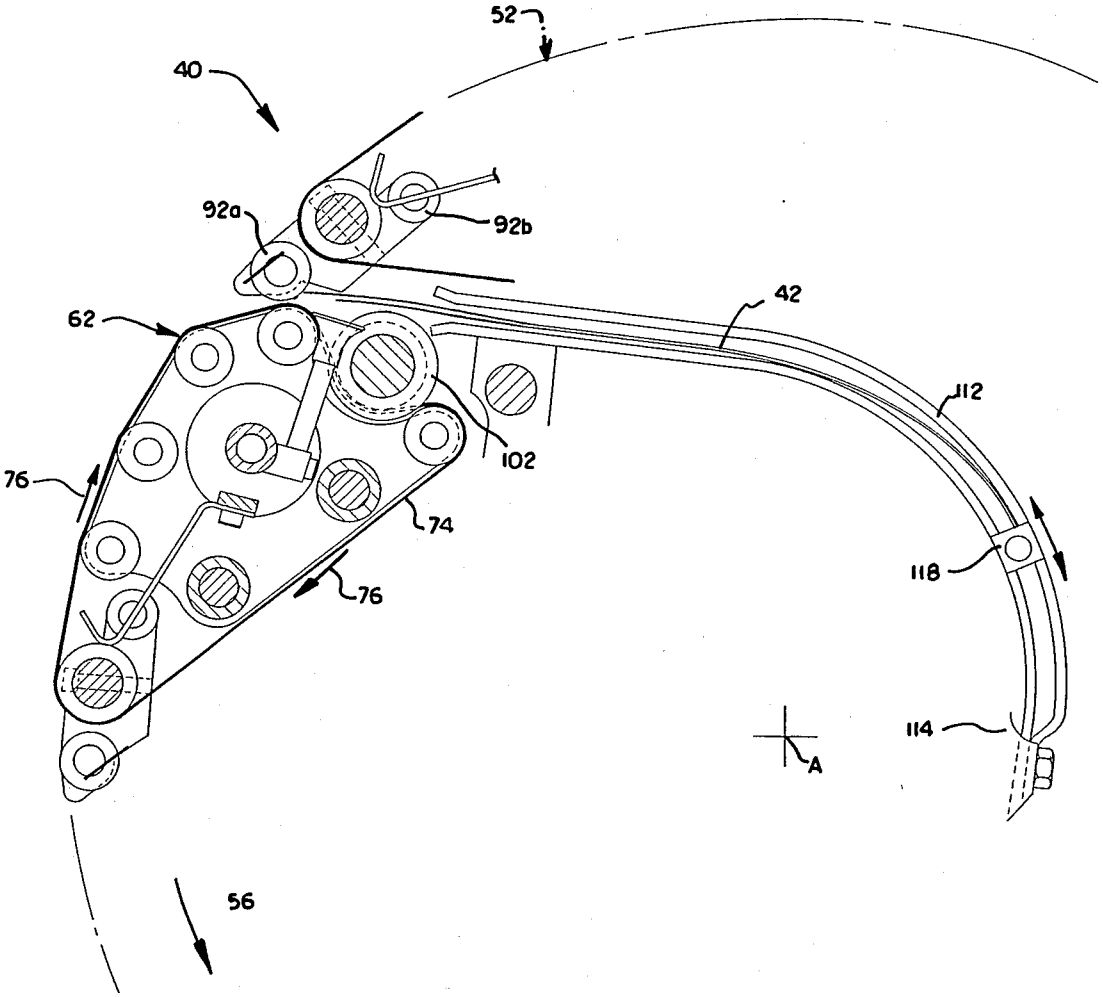

FIG. 6 illustrates the signature handling apparatus 40 rotated further in the direction 56 from the position of FIG. 5. The signature 42 has been completely removed from the hopper 24. The belts 74 acting with the pincher roller **92*a* of the following feeder have driven the signature 42 sufficiently into the feeder 62 so that no portion of the signature extends outside the periphery of the drum 52. The signature 42 has been driven into the storage rack 112 to the position in which the folded edge portion of the signature engages the stop 118. The stop 118 is adjusted to an appropriate position along the storage rack 112. The trailing edge portion of the signature 42 is disposed between the out-feed roller 102 and the pincher roller 92*b*** of the following feeder.

Figure 7:
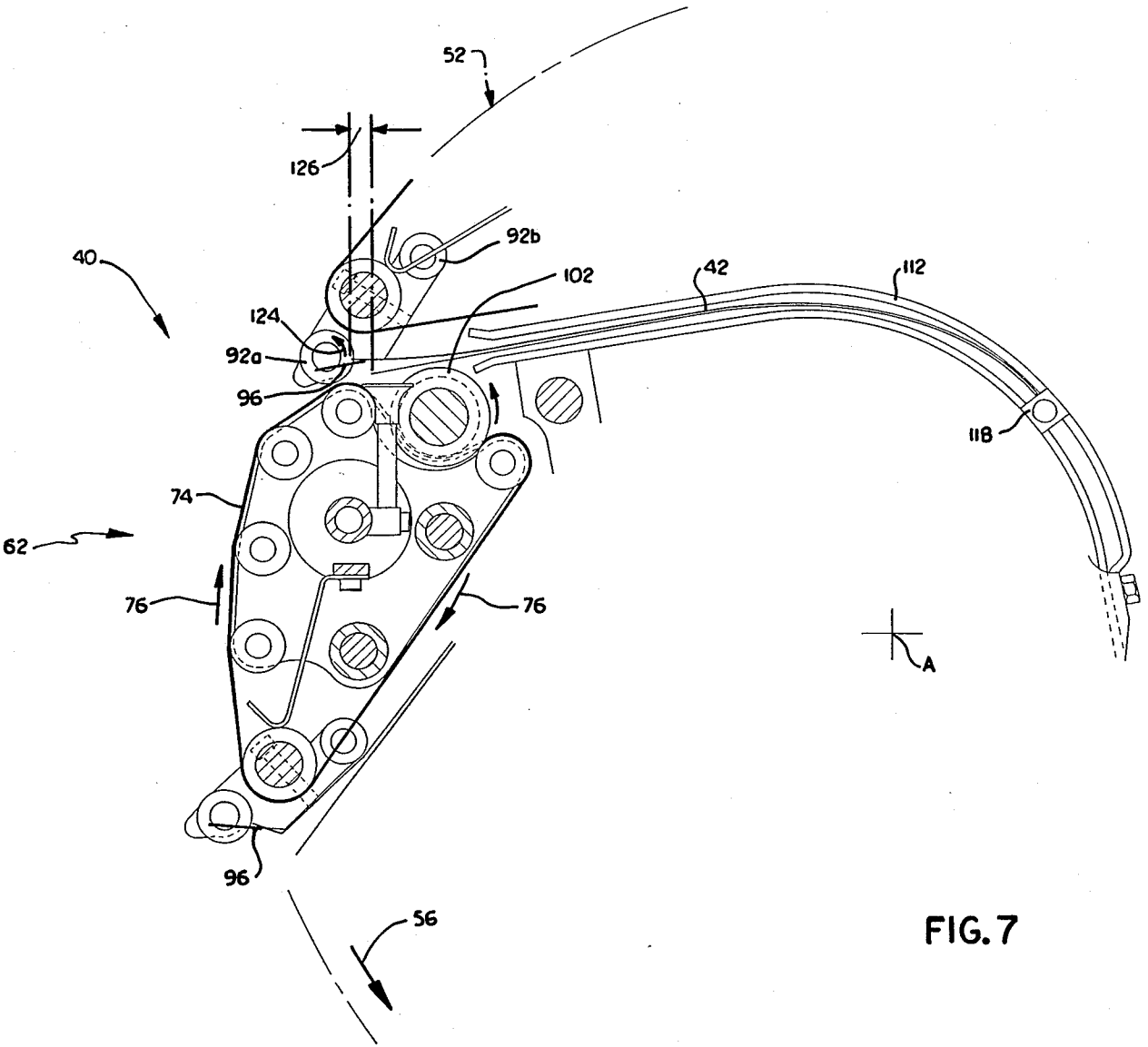

FIG. 7 illustrates the drum 52 rotated further in the direction 56 from the position of FIG. 6. The opener arm 96 has pivoted in a direction indicated by the arrow 124 to engage one of the sheet sections of the signature 42. The sheet sections of the signature 52 have different lengths, as illustrated in FIG. 7. An overlap portion 126 exists between the ends of the two sheet sections. The longer sheet section is disposed on the top side of the signature 42 in the storage rack 112, as viewed in FIG. 7. Thus, the opener arm 96 engages the overlap portion 126 in order to slightly displace, or open, the upper sheet section from the lower sheet section. It is during this operation at which the distance that the signature 42 extends into the storage rack 112 is critical. If the signature 42 extends too far into the storage rack 112, the opener arm 96 will not engage the overlap portion 126 of the signature. If the signature 42 does not extend far enough into the storage rack 112, the opener arm 96 will engage the lower sheet section of the signature and not open the signature at all. Thus, adjustment of the stop 118 to a predetermined location along the length of the storage rack 112 is critical to the opening of the signature 42.

Figure 8:
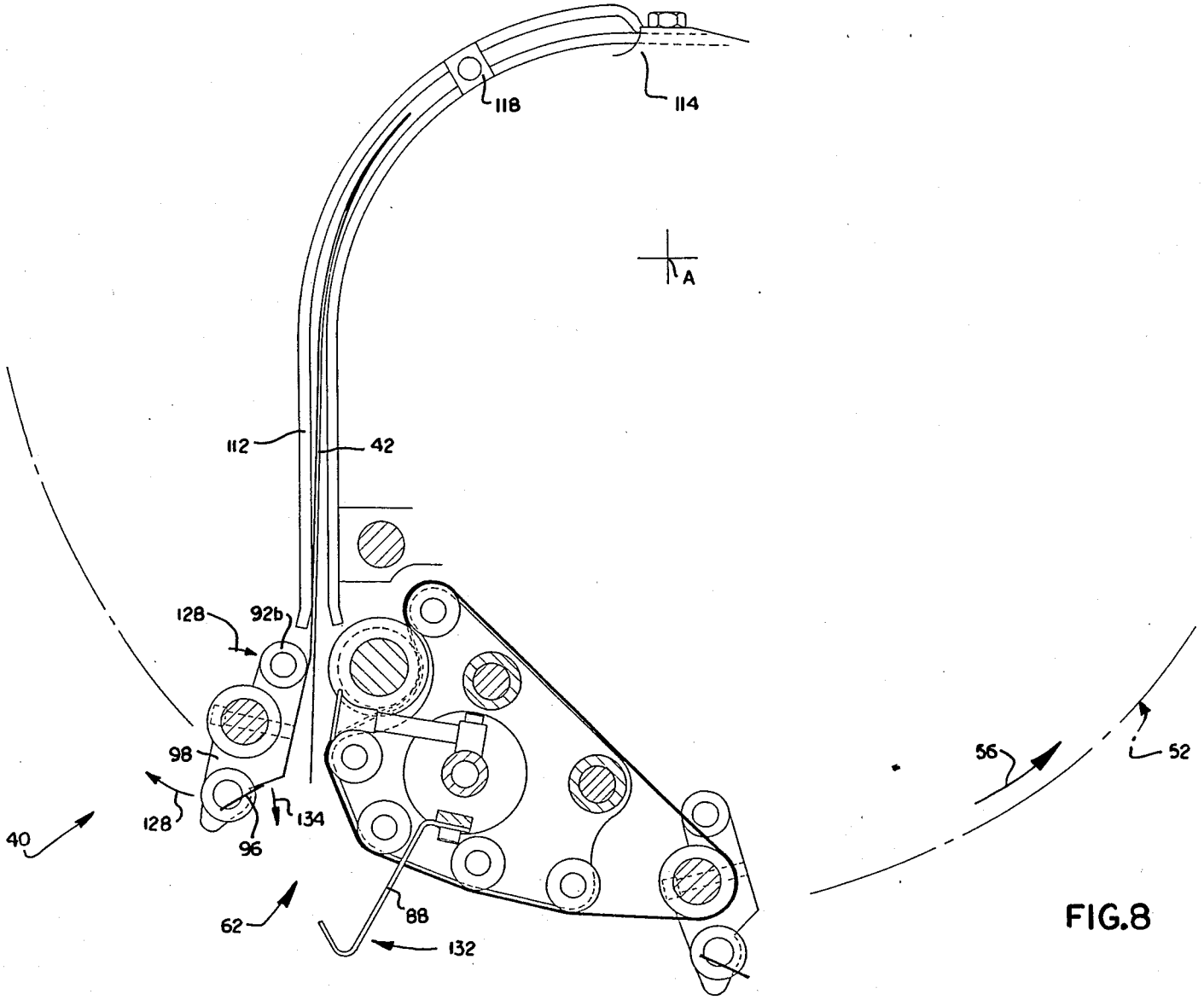

FIG. 8 illustrates the drum 52 rotated further in the direction 56 from the position of FIG. 7. The support bracket 98 pivots in the direction indicated by the arrows 128. This causes the opener arm 96 to open the signature 42 a greater amount than is illustrated in FIG. 7. Also, the pincher roller **92*b* starts to engage the signature 42. Due to the pivotal movement of the support bracket 98, the signature 42 is pulled in an outward direction of the storage rack 112 a slight amount. The bent wire opener 88 has pivoted in the direction indicated by the arrow 132. The opener arm 96 pivots in the direction indicated by the arrow 134 to maintain the signature 42 in an open condition without preventing the signature from moving outwardly of the storage rack 112**.

Figure 9:
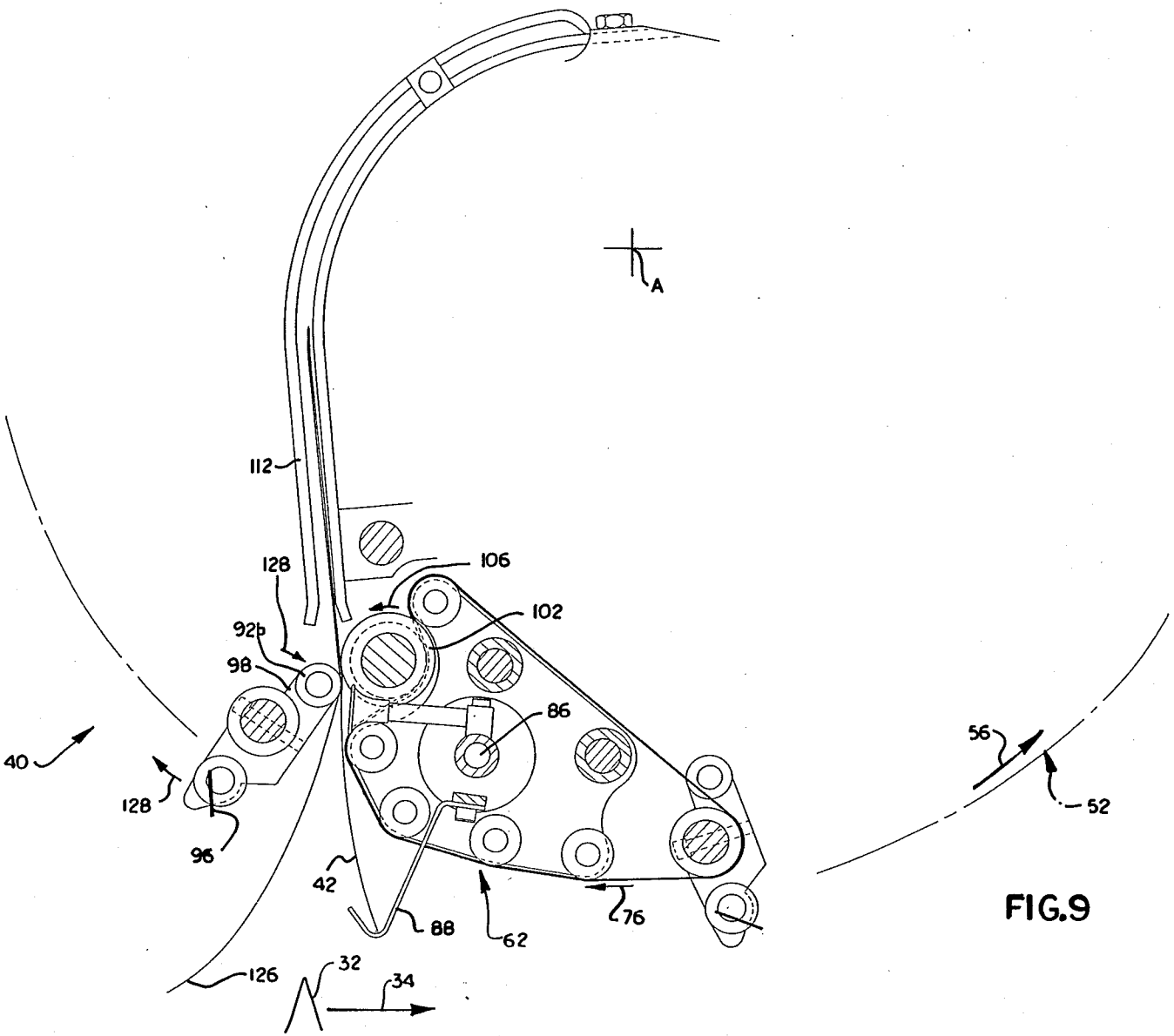

FIG. 9 illustrates the feeder 62 rotated in the direction 56 slightly further than the position of FIG. 8. The support bracket 98 has pivoted further in the direction 128 so that pincher roller **92*b* exerts a slight force against the signature 42 and out-feed roller 102. This creates friction between the signature 42 and the out-feed roller 102. Since the out-feed roller 102 is rotating in the direction 106, the signature 42 is forced, or fed, outwardly of the storage rack 112. Concurrently, the opener arm 96 has pivoted out of engagement with the overlap portion 126 of the signature 42. The shorter sheet section of the signature 42 engages the inner surface of the V portion of the bent wire opener 88. The bent wire opener 88 pivots counterclockwise, as viewed in FIG. 9, about shaft 86 further opening the signature 42. This occurs as the drum 52 rotates in the direction 56 and the longer sheet section of the signature 42 starts to fit over one of the saddles, or support bars, 32 which is moving along the conveyor path 34 below the signature handling apparatus 40. The saddle 32 is moved along the path 34 at a speed proportional to the speed of rotation of the drum 52 so that each feeder 62 can deliver a signature 42 to a saddle 32** in a timed relationship.

Figure 10:
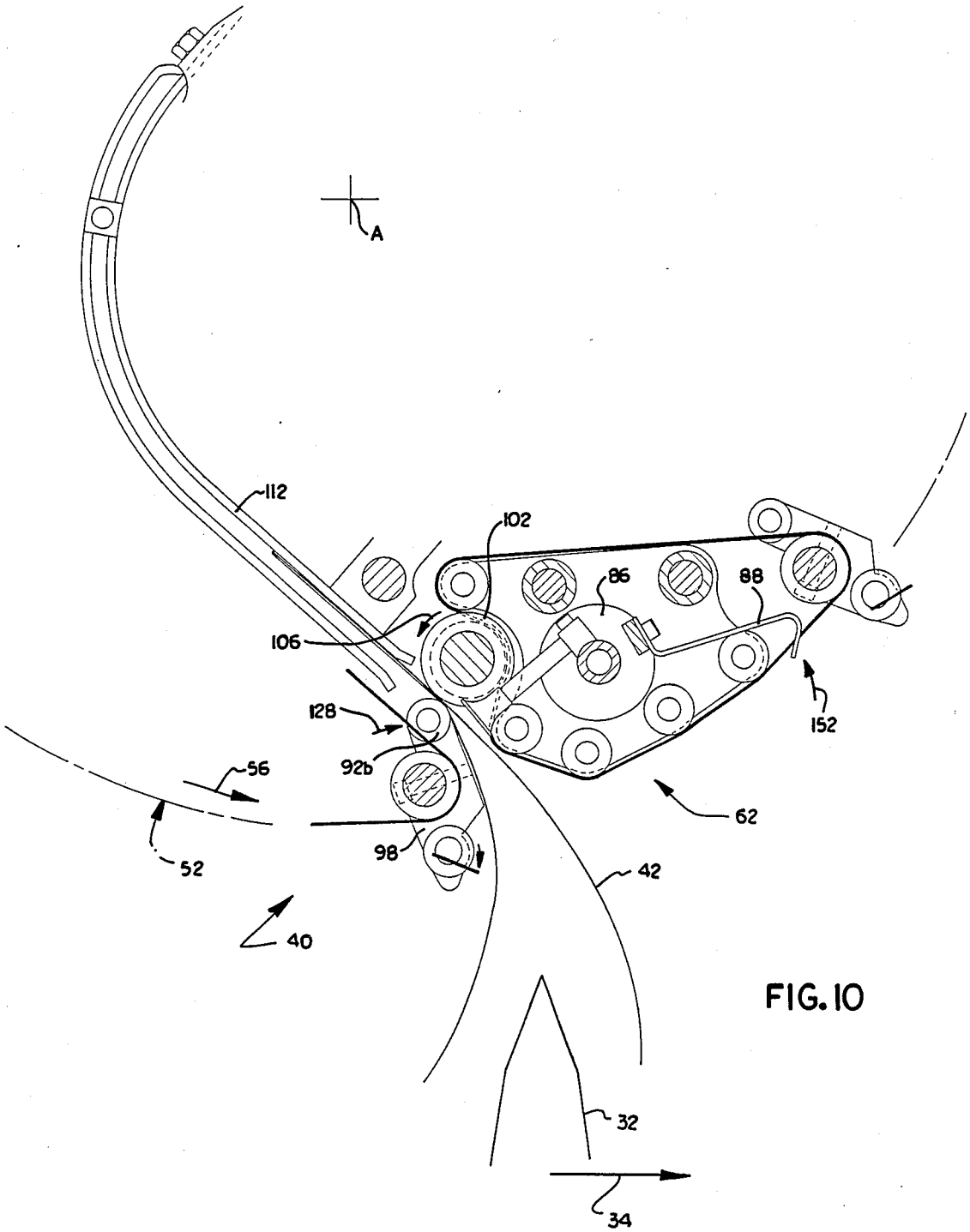

FIG. 10 illustrates the drum 52 rotated further in the direction 56 from the position of FIG. 9. The signature 42 is still engaged by the pinch roller **92*b* and the out-feed roller 102. The signature 42 is being driven downwardly by the friction between the pincher roller 92*b* and the out-feed roller 102. This further forces the open signature 42 onto the saddle 32 in a straddling relationship. The bent wire opener 88 pivots counterclockwise in the direction indicated by the arrow 152 about the shaft 86 and fully releases the signature 42. It will be apparent that with just a small amount of further rotation of the drum 52 in the direction 56 and further movement of the signature 42 out of the storage rack 112 that the signature will completely overlie the saddle 32**.

Figure 11:
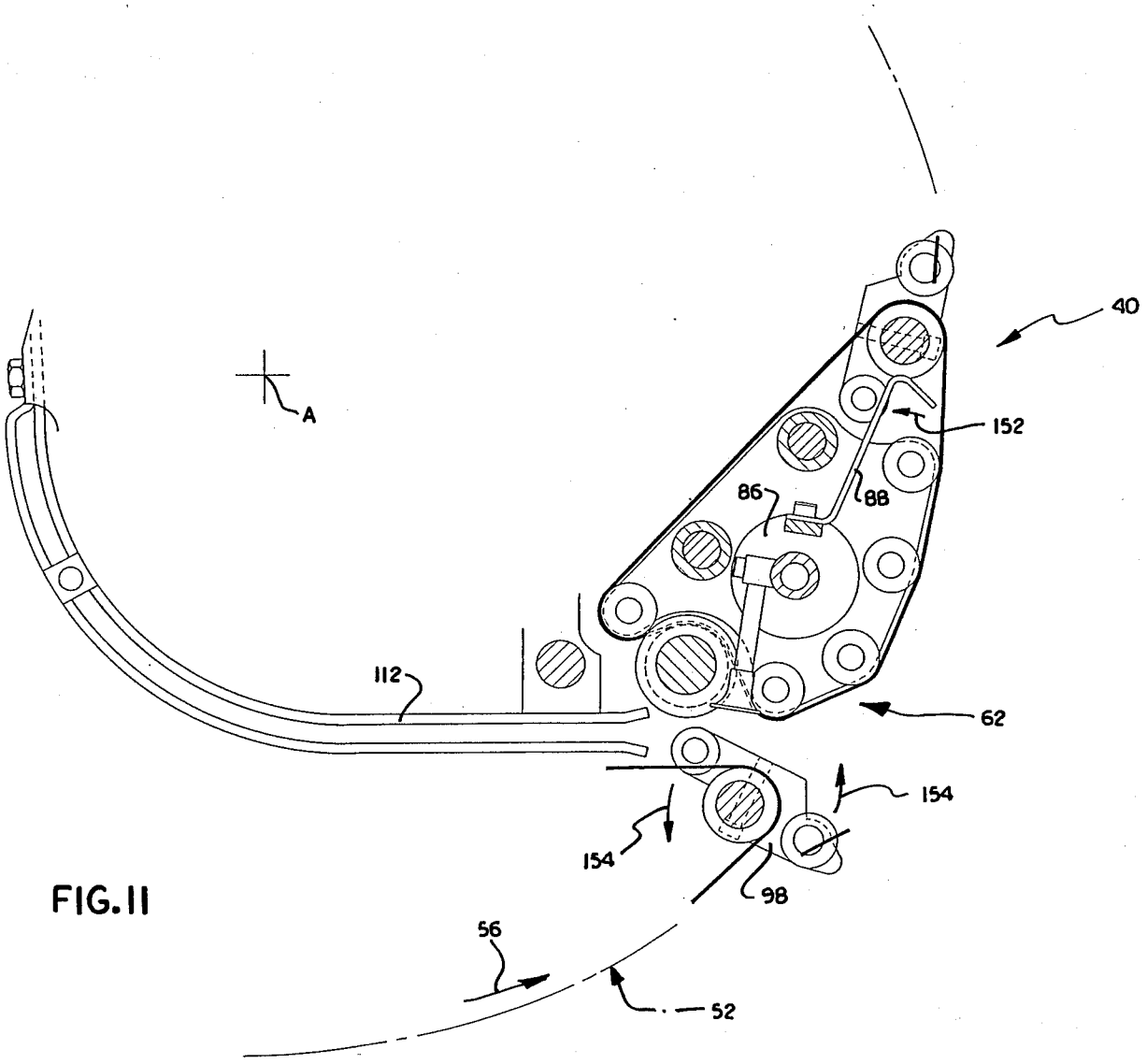

FIG. 11 illustrates the feeder 62 rotated in the direction 56 from the position of FIG. 10 and after the signature 42 has been delivered to the saddle 32. The support bracket 98 pivots the pincher roller 92*b* in the direction 154 towards a closed, or nonactive, position within the periphery of the drum 52. The bent wire opener 88 pivots in the direction 152 to the fully retracted position so that it will not interfere with the next signature 42 to be fed into the feeder 62.

Figure 12:
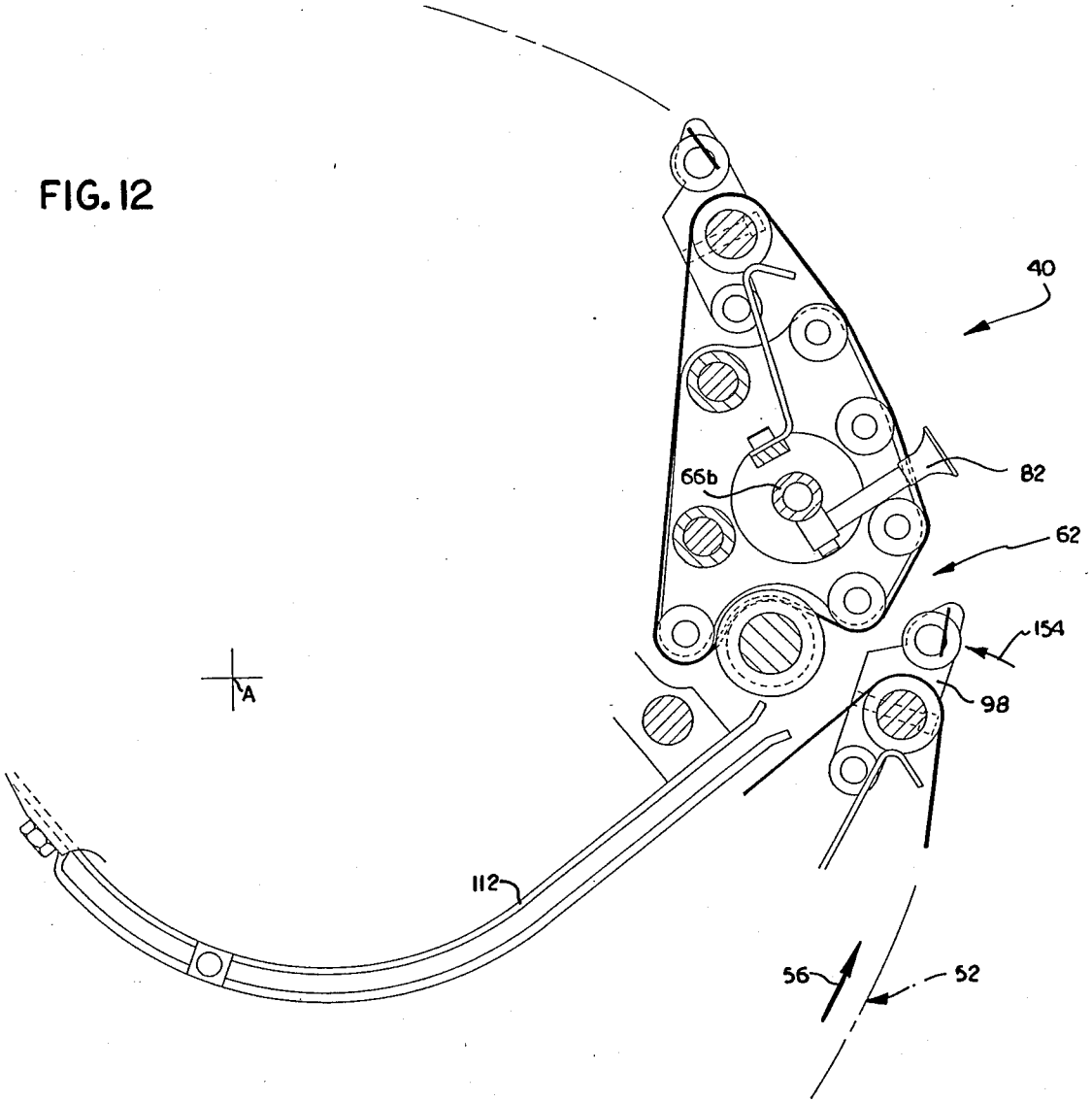

FIG. 12 illustrates the feeder 62 rotated further in the direction 56 from the position of FIG. 11. The support bracket 98 continues to pivot even further in the direction 154 to the closed position. The gripper 82 begins to pivot into a position in which it can engage the leading edge of another signature 42 upon further rotation of the drum in the direction 56. The entire feed cycle is then repeated, as just described. It must be pointed out that each of the feeders 62 are performing the various operations concurrently. Their function at any time is dependent upon the relative rotational position of the drum 52.

Thus, a signature handling apparatus 40 is provided which can operate at relatively increased speeds. The signature handling apparatus 40 is not dependent upon the thickness or strength of the signature 42 to be handled. It should also be apparent that the signature handling apparatus 40 is not limited by the size of the signature because the signature does not have to be stored on the outer surface of the drum 52.

From the above description of a preferred embodiment of the invention, those skilled in the art will perceive improvements, changes and modifications. Such improvements, changes and modifications within the skill of the art are intended to be covered by the appended claims.

Having described a preferred, I claim:

1. An apparatus for feeding signatures from a hopper, said apparatus comprising:

a rotatable drum;

first feed means mounted on said drum for feeding a first signature from the hopper during rotation of said drum through a predetermined arcuate distance; and second feed means mounted on said drum for partially feeding a second signature from the hopper during rotation of said drum through a second arcuate distance during the feeding of the first signature from the hopper;

said second feed means including means for engaging the second signature and initiating feeding of the second signature from the hopper while said first feed means is feeding the first signature from the hopper;

said first feed means including first belt means for feeding the first signature from the hopper to said drum;

said second feed means including second belt means for feeding the second signature from the hopper to said drum; and means driven with said first belt means for feeding the first signature from the drum.

2. An apparatus as set forth in claim 1 further including means for defining a plurality of locations for holding signatures during rotation of said drum, at least a major portion of each of said plurality of locations being disposed inwardly of the periphery of said drum.

3. An apparatus as set forth in claim 2 wherein said first feed means feeds the first signature with a folded edge portion leading into a first one of said plurality of locations.

4. An apparatus as set forth in claim 3 further including opening means for engaging an open trailing edge portion of the first signature disposed in said first location and separating adjacent sheet sections.

5. An apparatus as set forth in claim 1 further including further feed means, said first, second, and further feed means being circumferentially spaced about said drum a distance which is less than the length of a signature.

6. An apparatus as set forth in claim 2 further including means adjustably mounted along a respective one of said plurality of locations for engaging the leading edge portion of the signature disposed in said location to establish the stored position of the signature relative to said location.

7. An apparatus comprising:

a hopper for receiving a stack of signatures disposed in abutting relationship, said stack including a bottom signature, a signature next to the bottom signature and additional signatures;

a drum rotatable about its axis and located adjacent said hopper;

first feed means mounted on said drum for rotation therewith about the axis of said drum for removing the bottom signature from the stack of signatures in said hopper during rotation of said drum through a predetermined arcuate distance; and second feed means mounted on said drum for rotation therewith about the axis of said drum for partially removing the signature next to the bottom signature from the stack of signatures in said hopper during rotation of said drum through said predetermined arcuate distance during the removal of the bottom signature from the hopper;

said second feed means including means for engaging the signature next to the bottom signature and initiating movement of the signature next to the bottom signature relative to the additional signatures and from the stack of signatures in said hopper while said first feed means is removing the bottom signature from the stack of signatures in said hopper;

said drum including first storage means disposed inwardly of the periphery of said drum for holding the bottom signature completely inwardly of the periphery of said drum during rotation of said drum after the bottom signature has been fed from said hopper and released by said first feed means into said first storage means, said first feed means including means for initiating movement of the bottom signature into said first storage means during rotation of said drum through the predetermined arcuate distance.

8. An apparatus as set forth in claim 7 wherein said first feed means comprises support means for said stack of signatures, said bottom signature transmitting weight of other signatures in said stack to said support means, said support means comprising endless belt means having a signature support surface, said apparatus further comprising means for moving said signature support surface relative to said drum and in a direction opposite to the direction of rotation of said drum at a surface speed substantially equal to the surface speed of said drum due to rotation of said endless belt means with said drum.

9. An apparatus as set forth in claim 8 wherein said initiating means comprises gripper means disposed on said drum for engaging a portion of said bottom signature and for moving the engaged portion of the bottom signature relative to said belt means.

10. An apparatus as set forth in claim 7 further including conveyor means disposed adjacent a side of said drum opposite from the hopper, said first feed means including means for holding the bottom signature during rotation of said drum through a second arcuate distance greater than said predetermined arcuate distance after the bottom signature has been removed from the hopper by said first feed means and for delivering the bottom signature to said conveyor means after said drum has rotated through the predetermined arcuate distance and the second arcuate distance.

11. An apparatus as set forth in claim 7 wherein said bottom feed means includes means for moving the bottom signature relative to said drum in a direction opposite to the direction of rotation of said drum.

12. An apparatus as set forth in claim 7 further including conveyor means for receiving signatures from said drum and conveying signatures away from said drum, said first feed means including gripper means for gripping a first edge portion of the bottom signature during at least a portion of the feeding of the bottom signature from the hopper and means for delivering the bottom signature to said conveyor means with an edge portion of the bottom signature opposite from the first edge portion leading.

13. An apparatus as set forth in claim 12 wherein said conveyor means includes a plurality of signature supports each having a longitudinal axis, said signature supports being movable in a path below said drum having their longitudinal axes substantially parallel to the axis of rotation of said drum.

14. An apparatus as set forth in claim 13 wherein the first edge portion of the bottom signature is folded and said means for delivering the bottom signature to said conveyor means includes means for opening the edge opposite the folded edge of the bottom signature and depositing the bottom signature onto one of said signature supports in a straddling relationship.

15. An apparatus comprising:

a hopper for receiving a stack of signatures disposed in abutting relationship, said stack including a bottom signature and a signature next to the bottom signature;

a drum rotatable about its axis, located adjacent said hopper and having first and second storage locations for holding the bottom signature and the signature next to the bottom signature;

first and second belts on said drum for rotation therewith about the axis of said drum, said first and second belts simultaneously engaging the bottom signature in said hopper and the signature next to the bottom signature in said hopper espectively; and means for simultaneously driving said first and second belts relative to said drum in a direction opposite to the direction of rotation of said rum at a surface speed substantially equal to the surface speed of said drum due to rotation of said first and second belts with said drum about the axis of said drum to simultaneously remove the bottom signature and the signature next to the bottom signature from said hopper and to advance the bottom signature and the signature next to the bottom signature into said first and second locations, respectively.

16. An apparatus as set forth in claim 15 further including conveyor means and first and second outfeed means for feeding the bottom signature and the signature next to the bottom signature from said first and second location onto said conveyor means.

17. An apparatus comprising:

a hopper for receiving a stack of signatures disposed in abutting relationship, said stack including a bottom signature, a signature next to the bottom signature and additional signatures;

a drum rotatable about its axis and located adjacent said hopper;

first feed means mounted on said drum for rotation therewith about the axis of said drum for removing the bottom signature from the stack of signatures in said hopper during rotation of said drum through a predetermined arcuate distance; and second feed means mounted on said drum for rotation therewith about the axis of said drum for partially removing the signature next to the bottom signature from the stack of signatures in said hopper during rotation of said drum through said predetermined arcuate distance during the removal of the bottom signature from the hopper;

said second feed means including means for engaging the signature next to the bottom signature and initiating movement of the signature next to the bottom signature relative to the additional signatures and from the stack of signatures in said hopper while said first feed means is removing the bottom signature from the stack of signatures in said hopper;

said drum including surface means for defining a plurality of locations for receiving signatures, said first feed means including means for initiating movement of the bottom signature from the hopper to a first one of the locations during rotation of said drum through the predetermined arcuate distance and said second feed means including means for initiating movement of the bottom signature from the first location during rotation of said drum after said drum has rotated through the predetermined arcuate distance.

18. An apparatus comprising:

a hopper for receiving a stack of signatures disposed in abutting relationship;

a drum rotatable about its axis and located adjacent said hopper;

a plurality of feed means mounted on said drum for rotation therewith about the axis of said drum for removing the signatures from the stack of signatures in said hopper during rotation of said drum, each of said plurality of feed means removing one signature at a time from the stack of signatures;

said drum including surface means for defining a plurality of storage locations for receiving signatures, the number of said storage locations corresponding to the number of said feed means;

each of said plurality of storage locations having adjustable stop means for accommodating various lengths of signatures to be received in each of the storage locations; and a plurality of infeeding means on said drum equal in number to the number of said feed means, each of said plurality of infeeding means cooperating with a respective feed means for feeding a respective signature into a respective storage location against the adjustable stop means therein.

19. An apparatus as set forth in claim 18 wherein each of said feed means comprises gripper means for initiating movement of a signature from the stack of signatures in the hopper and belt means movable relative to said drum in a direction opposite to the direction of rotation of said drum, and each of said plurality of infeeding means comprises a pinch roller movable into engagement with said belt means for feeding a respective signature into a respective storage location against the adjustable stop means therein.

20. An apparatus as set forth in claim 19 wherein each of said feed means comprises an out-feed roller movable relative to said drum in a direction of rotation of said drum for feeding a respective signature out of a respective storage location, and said apparatus comprises pinch roller means on said drum movable into engagement with said out-feed roller to feed the respective signature out of the respective storage location.

21. An apparatus as set forth in claim 18 wherein the stack of signatures includes a bottom signature and a signature next to the bottom signature, and said plurality of feed means comprises first and second feed means for removing the bottom signature and the signature next to the bottom signature from the stack of signatures in the hopper, respectively, said second feed means comprises means for engaging the signature next to the bottom signature and initiating movement of the signature next to the bottom signature relative to additional signatures and from the stack of signature in said hopper while said first feed means is removing the bottom signature from the stack of signatures in said hopper.

22. An apparatus comprising:

a hopper for receiving a stack of signatures disposed in abutting relationship, said stack including a bottom signature, a signature next to the bottom signature and additional signatures, each of said bottom ,ext to the bottom, and additional signatures having a folded edge portion and an open edge portion opposite the folded edge portion;

a collating conveyor for receiving signature from said hopper and for conveying the signatures away from said hopper;

feeder means located intermediate said hopper and said collating conveyor for removing signatures from said hopper and depositing the signatures on said collating conveyor, said feeder means comprising:

a rotatable drum, first feed means mounted on said drum for removing the bottom signature from the hopper during rotation of said drum through a first arcuate distance, second feed means mounted on said drum for removing the signature next to the bottom signature from the hopper during rotation of said drum through a second arcuate distance, said first feed means including gripper means for gripping the folded edge portion of the bottom signature during at least a portion of the feeding of the bottom signature from the hopper and means for feeding the bottom signature from the drum to said collating conveyor with the open edge portion of the bottom signature leading; and means on said drum for opening the open edge portion of the bottom signature before depositing the bottom signature onto said collating conveyor, said opening means comprising an opener arm for engaging one of the sheet sections of the bottom signature to initiate opening of the open end of the bottom signature and a support bracket on said second feed means for supporting said opener arm.

* * * * *

UNITED STATES PATENT AND TRADEMARK OFFICE

CERTIFICATE OF CORRECTION

PATENT NO. : 4,901,996

DATED : February 20, 1990

INVENTOR(S) : James R. Schlough

It is certified that error appears in the above-identified patent and that said Letters Patent is hereby corrected as shown below:

Column 8, Line 65, Claim 8, delete "drum" and insert --signature support surface--

Column 9, Line 56, Claim 15, delete " espectively" and insert --, respectively--

Column 9, Line 62, Claim 15, change "drum" to --first and second belts--

Column 11, Line 37, Claim 22, change ",ext" to --, next--

Signed and Sealed this

Twenty-fifth Day of December, 1990

*Attest:*

HARRY F. MANBECK, JR.

*Attesting Officer*

*Commissioner of Patents and Trademarks*